United States Patent [19]

Bradshaw

[11] Patent Number: 4,688,767

[45] Date of Patent: Aug. 25, 1987

[54] LOUVERED WALL

[76] Inventor: Richard J. Bradshaw, 3036 N. 32nd St., #317, Phoenix, Ariz. 85018

[21] Appl. No.: 901,320

[22] Filed: Aug. 28, 1986

[51] Int. Cl.[4] ..... E04H 17/00; E06B 7/08

[52] U.S. Cl. ..... 256/19; 52/198; 52/473; 52/663

[58] Field of Search ..... 256/19, 73; 52/198, 52/663, 473

[56] References Cited

U.S. PATENT DOCUMENTS

| | | | |
|---|---|---|---|
| 1,151,974 | 8/1915 | Straight | 256/19 |
| 1,154,219 | 9/1915 | Straight . | |
| 1,203,934 | 11/1916 | Straight | 52/663 X |
| 2,216,420 | 10/1940 | Rose | 256/19 X |
| 2,484,062 | 10/1949 | Abbott . | |
| 2,574,711 | 11/1951 | Rose | 256/19 |
| 2,877,989 | 3/1959 | Brodersen | 256/19 |
| 4,498,660 | 2/1985 | Brema et al. | 256/19 |

FOREIGN PATENT DOCUMENTS

| | | | |
|---|---|---|---|
| 637960 | 3/1962 | Canada | 256/19 |

OTHER PUBLICATIONS

The Complete Book of Fences, First Edition, Dan Ramsey, Copyright 1983 Tab Books.

*Primary Examiner*—Alfred C. Perham

*Attorney, Agent, or Firm*—Cahill, Sutton & Thomas

[57] ABSTRACT

A louvered wall is formed of spaced stacks of thin masonry blocks with elongated louvers disposed between adjacent blocks and extending longitudinally of the wall through several stacks of blocks. The middle longitudinal region of each louver is higher than its longitudinal edge regions and the upper and lower surfaces of the blocks are shaped to conform to the cross-sectional configuration of the louvers to lock the blocks and louvers against transverse movement.

4 Claims, 4 Drawing Figures

LOUVERED WALL

TECHNICAL FIELD

This invention is concerned with the construction of a wall which provides privacy to an adjoining space, but permits substantial flow of air to and from the space.

BACKGROUND ART

Louvered walls have long been used to enclose outdoor spaces occupied by humans to provide privacy and to permit the flow of air to and from the spaces. Such walls are particularly desirable around relatively small enclosed spaces, such as those containing patios or swimming pools, for which a solid wall would produce uncomfortable, confining feelings in the occupants of the space.

Of course, it is common to fabricate a louvered wall from lumber. Such structures are expensive because of the complexity of fabrication and the cost of raw materials. There is the further problem of maintenance of outdoor wood structures. They must be painted or otherwise treated periodically to prevent deterioration.

Masonry block walls are relatively inexpensive. And it has been proposed to provide air passageways through the masonry blocks for ventilation purposes. See, for example U.S. Pat. No. 1,154,219 granted Sept., 21, 1919 to H. R. Straight for "Ventilated Building Structure" and U.S. Pat. No. 1,203,934 granted Nov. 3, 1916 to H. R. Straight for "Ventilated Building Block". Blocks constructed in accordance with the teachings of these patents offer only very restricted passageways for the flow of air therethrough. Hence, walls constructed of these blocks would afford very little air movement and comfort to the persons in spaces enclosed by those walls.

It has also been proposed to configure the upper and lower surfaces of cement building blocks in such a manner that a portion of each block projects into a corresponding region of the block next above. The blocks disclosed in the Straight '934 patent mentioned previously have this characteristic. See also U.S. Pat. No. 2,484,062 granted Oct. 11, 1949 to J. E. Abbott for "Concrete Block Building Wall". The interconnection of blocks which are so configured is known to stabilize the wall constructed therefrom. Applicant, however, has no knowledge of the blocks of the Abbott patent or the aforementioned Straight patents being used in combination with elongated louvers to construct a stabilized louvered wall.

DISCLOSURE OF THE INVENTION

The louvered wall of this invention is formed of spaced stacks of thin masonry blocks and elongated louvers extending longitudinally of the wall and positioned between adjacent blocks in two or more of the stacks of blocks. The middle longitudinal region of each louver is higher than its longitudinal edge region and the upper and lower surfaces of the blocks are shaped to conform to the cross-sectional configuration of the louver. The middle region of each louver is at a height above the edge regions thereof which is greater than the thickness of the louver. This means that the blocks, which conform to the louvers, have portions of a lower block extending up into a region of the block immediately above and hold the louver there between so that the blocks and the louvers are locked against transverse movement relative the wall. This contributes substantial stability to the wall and, in some instances, provides sufficient stability to eliminate the need for additional fastening means between the louvers and the blocks.

The blocks are preferrably molded from concrete or cinder aggregate to provide durability and low cost. The louvers may be similarly made for the same reasons. If desired, however, the louvers can be formed of equally durable and attractive sheet plastic, asbestos or metal.

BRIEF DESCRIPTION OF THE DRAWING

The invention is described in greater detail hereinafter by reference to the accompanying drawing wherein.

BEST MODE FOR CARRYING OUT THE INVENTION

Figure 1:
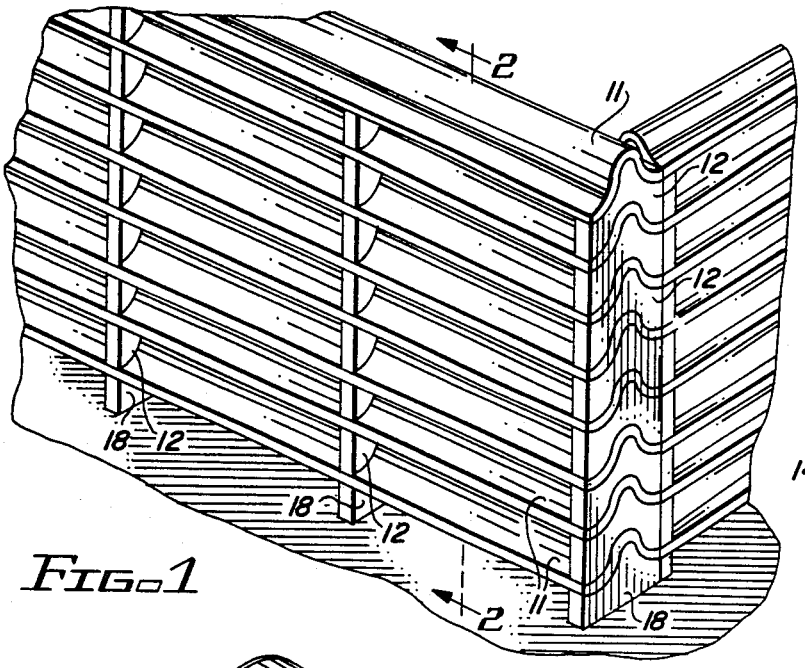
FIG. 1 is a ¾ perspective view of a portion of a wall structure embodying this invention.
Figure 2:
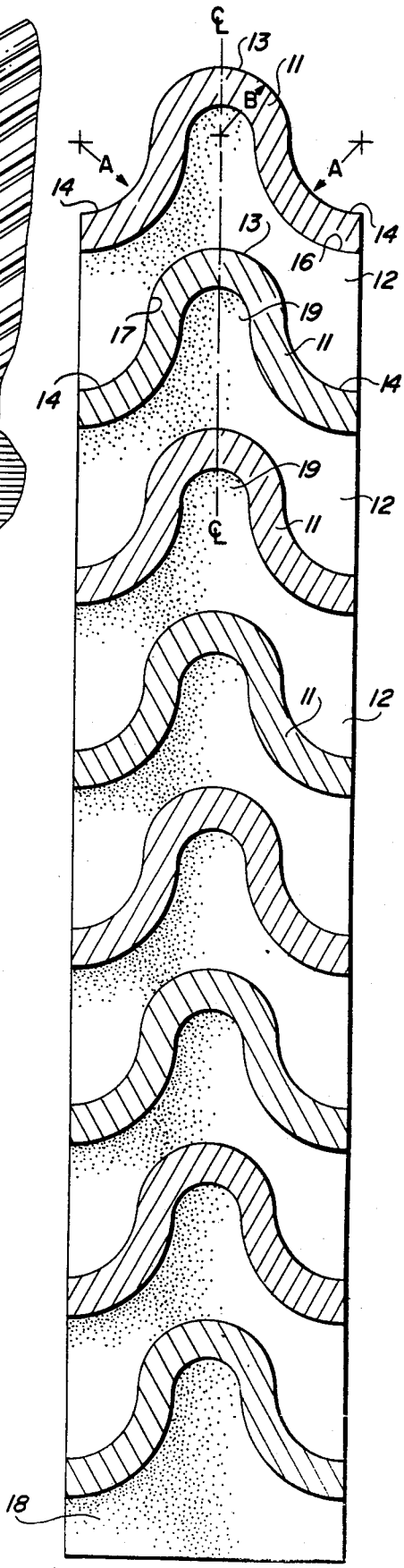
FIG. 2 is an enlarged vertical sectional view through the wall structure of FIG. 1 taken generally as indicated by the line 2—2 in FIG. 1.

As best shown in FIGS. 1 and 2 the preferred embodiment of this invention comprises a wall structure formed of a plurality of vertically spaced, longitudinally extending louvers 11 supported by spaced stacks of blocks 12. The blocks 12 are of masonry construction, preferrably molded concrete or cinder aggregate. The louvers 11 may also be formed of molded or extruded cement or asbestos. The louvers may also be formed of sheet material, such as plastic or metal. The primary consideration in the selection of materials is weather durability because the wall structures embodying this invention are intended primarily for outdoor applications.

Figure 3:
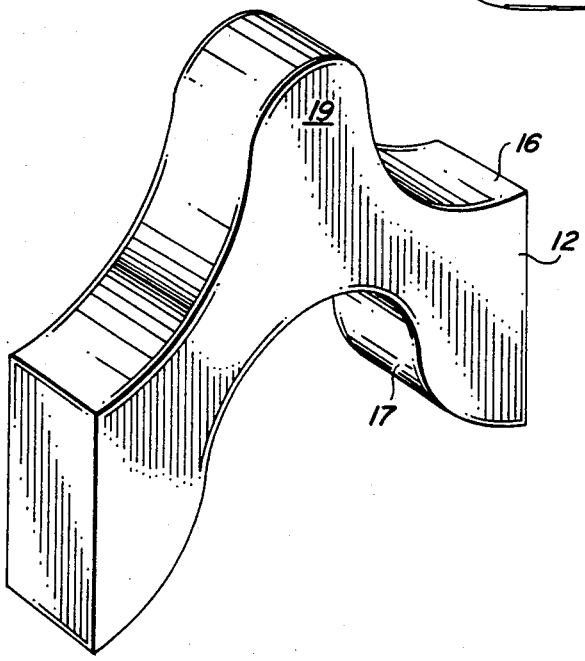
FIG. 3 is an enlarged perspective view of a block utilized in the construction of the wall shown in FIG. 1.

Both the louvers 11 and the blocks 12 are configured to obstruct the line of sight through the wall structure, for privacy, and to leave a substantial area of the wall open to permit the flow of air therethrough. The most preferred configurations for the louvers 11 and the blocks 12 are those illustrated in FIGS. 1, 2 and 3. It will be noted that each of the louvers 11 has a middle longitudinal region 13 extending along its center line which is raised with respect to longitudinal edge regions 14 of the louver. With this configuration the uppermost portion of the middle region 13 or each louver 11 is at substantially the same level as the lowermost portion of the edge regions 14 of the louver immediately above. This arrangement blocks the sight lines through the wall and provides the privacy that is desired.

The upper and lower surfaces 16 and 17 respectively, of most of the blocks 12 are configured to correspond to the surface configuration of the louvers 11. The exception to this is the lowermost block 18 in each stack of blocks which is provided with a flat under surface to rest on the surface on which the wall is constructed.

The curvilinear configuration of the cross-section of each louver 11 illustrated in FIGS. 1 and 2 is particularly advantageous. This configuration is characterized by having the radii of curvature of the longitudinal edge regions 14 of each louver (radius A in FIG. 2) equal to the radius of curvature of the upper surface of the middle longitudinal region 13 of each louver (radius B in FIG. 2). The curvature of the longitudinal edge regions 14 are opposite the curvature of the middle region 13 producing a cross-section which ressembles two opposite S-curves joined end to end at the center line of the louver. This cross-sectional configuration for the louvers 11 imparts considerable strength and stiffness to the louvers so that they are capable of resisting any bending and twisting moments to which they may be subjected. The louvers 11 preferrably have a substantially uniform thickness from edge to edge.

The overall configuration of the louvers 11 is such that they can be easily manufactured either by molding or by extruding or by rolling sheet material to the desired configuration.

It is further to be noted that the height distance between the middle region 13 of each louver 11 and the edge regions 14 thereof is greater than the thickness of the louver. As a result of this relationship the blocks 12 which have their upper and lower surfaces 16 and 17 configured to conform to the surfaces on the louvers 11 have their upper projecting portions 19 extending into concave regions in the lower surfaces 17 of the block 12 immediately above to lock adjacent blocks together with the louvers 11 therebetween. This interconnection of the blocks 12 and louvers 11 resists transverse movement of the blocks and the louvers and imparts substantial stability to the wall structure formed thereby. In most instances, this interlocking action is such that no additional fastening means need be utilized in the wall to join the several louvers and blocks together. The weight of the louvers 11 and blocks 12 together with their interconnecting configurations is sufficient to keep the components of the wall in place.

The thickness of each of the blocks 12 and 18 (measured longitudinally of the wall) is substantially less than the width of each block so as to minimize the obstruction to air flow through the wall. In a typical wall having a thickness of 8 inches the blocks 12 may have a thickness of 2 to 3 inches and the louvers 11 will have a thickness of approximately 1 inch.

Figure 4:
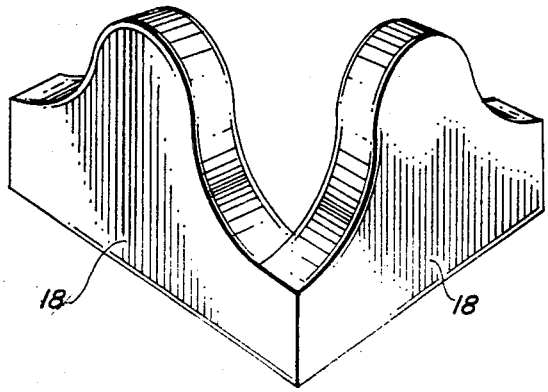
FIG. 4 is an enlarged perspective view of a modified block for use in constructing a corner of a wall.

Another embodiment of the invention is illustrated in FIG. 4. Here two lowermost blocks 18 are formed integrally at one angle to each other. These integral blocks and similarly formed spacer blocks 12 can be used at the corners or junctions of runs of the louvered wall to further strengthen the wall structure.

For best results with the wall constructions illustrated in FIGS. 1 and 2 the louvers 11 are preferrably made long enough so that they extend through two or more of the stacks of blocks 12. The use of the longer louvers also simplifies erection of the wall. It is to be noted, however, that all of the louvers need not be of the same length. Indeed, with louvers of different lengths, the junctions in the individual louvers are staggered throughout the height of the wall thereby eliminating any unnecessary weak spots in the wall.

What is claimed is:

1. A louvered wall comprising spaced stacks of masonry blocks and a plurality of louvers extending longitudinally of the wall in vertical spaced relationship with each louver passing between a pair of blocks in a least two stacks of blocks, each said louver being characterized by having a middle longitudinal region which is raised with respect to the longitudinal edge regions thereof and the middle region has a convex upper surface and the edge regions have concave upper surfaces, and the blocks being characterized by having upper and lower surfaces corresponding to the cross-sectional configuration of said louvers.

2. The wall of claim 1 further characterized in that the radius of curvature of the upper surface of the middle region of each louver is equal but opposite to the radius of curvature of the upper surface of each edge region of each louver.

3. The wall of claim 1 further characterized in that each louver in cross-section ressembles two opposite S-curves joined end to end at the centerline of the louver.

4. The wall of claim 1 further characterized in that the wall has at least two runs at an angle to each other and the ends of the louvers in one run at the junction of the runs are carried by blocks which are integrally formed with adjoining blocks supporting the ends of the louvers in the other run.

* * * * *